US010137593B2

(12) United States Patent
Riondet et al.

(10) Patent No.: US 10,137,593 B2
(45) Date of Patent: Nov. 27, 2018

(54) MITER BOX

(71) Applicant: 3M BRICOLAGE ET BÂTIMENT, Oyonnax (FR)

(72) Inventors: Stephane Riondet, Varces (FR); Isabelle Martin, La Motte d'Aveillans (FR)

(73) Assignee: 3M Innovative Properties Company, St. Paul, MN (US)

( * ) Notice: Subject to any disclaimer, the term of this patent is extended or adjusted under 35 U.S.C. 154(b) by 45 days.

(21) Appl. No.: 14/888,097

(22) PCT Filed: May 2, 2014

(86) PCT No.: PCT/EP2014/058973
§ 371 (c)(1),
(2) Date: Oct. 30, 2015

(87) PCT Pub. No.: WO2014/180746
PCT Pub. Date: Nov. 13, 2014

(65) Prior Publication Data

US 2016/0052160 A1 Feb. 25, 2016

(30) Foreign Application Priority Data

May 6, 2013 (FR) ..... 13 54127

(51) Int. Cl.
*B23Q 3/00* (2006.01)
*B27G 5/02* (2006.01)

(52) U.S. Cl.
CPC ..... *B27G 5/026* (2013.01)

(58) Field of Classification Search
USPC ..... 269/288, 16, 295; 83/581, 762, 820
See application file for complete search history.

(56) References Cited

U.S. PATENT DOCUMENTS 3,171,453 A * 3/1965 Brownrigg ..... B27G 5/02 83/762
3,282,235 A 11/1966 Crawford
3,782,235 A * 1/1974 Curcio ..... B27G 5/02 83/762
3,935,779 A * 2/1976 Hildebrandt ..... B27G 5/02 83/762
4,281,827 A * 8/1981 Horwath ..... B27G 5/02 269/189
4,377,959 A * 3/1983 DeCarolis ..... B27G 5/02 269/295
4,712,462 A 12/1987 Cvek
D333,768 S * 3/1993 Schulenberg ..... D8/64
(Continued)

FOREIGN PATENT DOCUMENTS

CA 68400 8/1900
CH 665165 A5 * 4/1988 ..... B27G 5/02
(Continued)

OTHER PUBLICATIONS

International Search report for PCT International Application No. PCT/EP2014/058973 dated Jun. 3, 2014, 4 pages.

*Primary Examiner* — Joseph J Hail
*Assistant Examiner* — Shantese McDonald
(74) *Attorney, Agent, or Firm* — Kevin Weber

(57) ABSTRACT

A miter box includes, in a first direction, a through opening having a shape adapted to the cross-section of an element to be cut.

17 Claims, 3 Drawing Sheets

(56) References Cited

U.S. PATENT DOCUMENTS

| | | | | | |
|---|---|---|---|---|---|
| 5,522,296 | A * | 6/1996 | Stoller | B27G 5/02 | 269/288 |
| 5,813,306 | A * | 9/1998 | Jacoff | B27G 5/02 | 83/468 |
| 6,237,459 | B1 * | 5/2001 | Brown | B27G 5/026 | 83/454 |
| 6,668,695 | B2 * | 12/2003 | Poole | B25B 5/08 | 269/283 |
| 7,194,811 | B2 * | 3/2007 | Militello | E06B 9/266 | 33/194 |
| 8,371,200 | B2 | 2/2013 | Zhang | | |
| 2002/0029678 | A1 * | 3/2002 | Erisoty | B27G 5/02 | 83/766 |
| 2005/0166742 | A1 * | 8/2005 | Collins | B27G 5/026 | 83/762 |

FOREIGN PATENT DOCUMENTS

| | | | | |
|---|---|---|---|---|
| FR | 2975418 | | 11/2012 | |
| FR | 3005282 | A1 * | 11/2014 | B27G 5/026 |
| WO | WO 2006-008538 | | 1/2006 | |
| WO | WO 2006008538 | A1 * | 1/2006 | B27G 5/026 |

* cited by examiner

MITER BOX

BACKGROUND

The present disclosure relates generally to the field of construction and, more specifically, to that of tools for finishing elements of the baseboard or section type. The present disclosure relates more specifically to a miter box.

Miter boxes for sawing, with fixed or adjustable angles, battens or baseboards, especially made of wood, are known. The use of such miter boxes is not very convenient because the operator must maintain the element to be cut against one or two surfaces of the miter box, either manually or with clamps for holding the element to be cut. Further, if the baseboard is thin or its cross-section is non-convex, i.e., the contour of the section has the property that for at least one pair of points on this contour a line joining the points is not wholly contained within the cross section, it risks breaking.

SUMMARY

The need exists for a miter box that overcomes all or part of the disadvantages of known miter boxes.

To achieve all or part of the foregoing, the present invention provides a miter box comprising, in a first direction, a through opening, having a shape adapted to the cross-section of an element to be cut. According to one embodiment, the opening may have a closed contour. According to another embodiment, the box may have a generally rectangular parallelepiped shape. According to another embodiment, the opening may emerge onto two lateral surfaces. According to another embodiment, the box may comprise at least one slot for defining a cut line entirely crossing the opening. According to another embodiment, the box may comprise a first slot following a plane perpendicular to the first direction, and two slots following planes forming respective angles of plus 45 degrees and minus 45 degrees with the first direction. In one embodiment, the planes do not intersect each other within the volume of the miter box. According to another embodiment, the slot or the slots may emerge onto at least upper, front and rear surfaces. According to another embodiment, the box may further comprise a base in which the slot or slots stop. According to another embodiment, a surface may comprise at least one protruding rib, approximately vertical, for aiding positioning for angle cuts.

Advantages of certain embodiments of the present invention include that it provides a miter box that is adapted to the cutting of elements having areas of different stiffnesses, it is adapted to the cutting of elements having a non-convex cross-section, and it is easy-to-use.

BRIEF DESCRIPTION OF THE DRAWINGS

The foregoing and other features and advantages of embodiments of the present disclosure will be discussed in detail in the following non-limiting description of specific embodiments in connection with the accompanying drawings.

DETAILED DESCRIPTION

Figure 1:
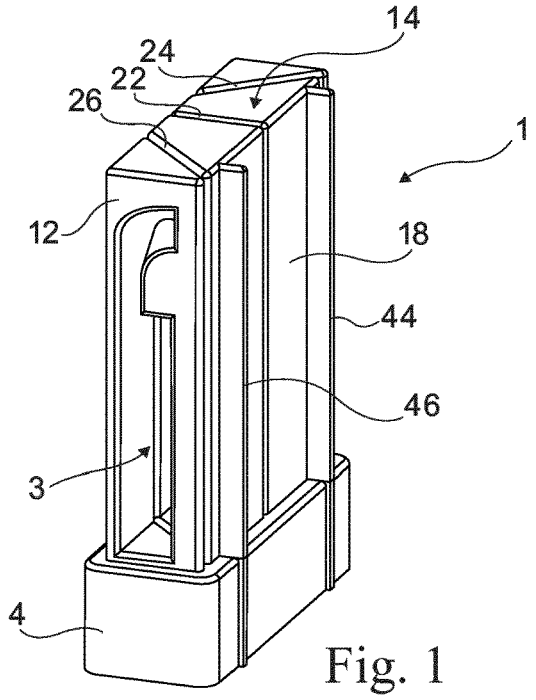
FIG. 1 is a perspective view of a miter box according to an embodiment of the invention.

In the drawings, like reference numerals refer to like or corresponding parts throughout the several views. For clarity, only those steps and elements which are useful to the understanding of the described embodiments have been shown and will be discussed in detail. In particular, the forming of a shaped element, for example, a baseboard, capable of being cut by means of a miter box has not been discussed in detail, the described embodiments being compatible with common baseboard and other shaped elements. Further, indications of position and orientation such as top, bottom, front, back, lateral, etc. are used, unless otherwise specified, by arbitrarily considering a miter box in a position of normal use. Further, unless otherwise specified, the exact dimensions and positions are given to within the manufacturing and positioning tolerances. The approximate dimensions and positions are provided to within 10% of the exact dimensions and positions.

Figure 2:
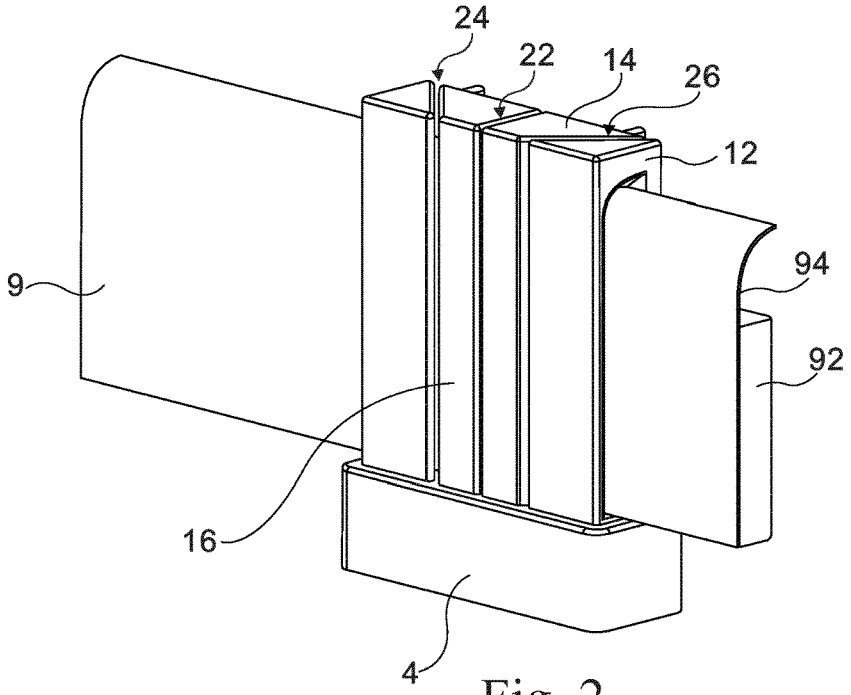
FIG. 2 is a simplified perspective view of an embodiment of the miter box of FIG. 1 in a baseboard cutting position.
Figure 3A:
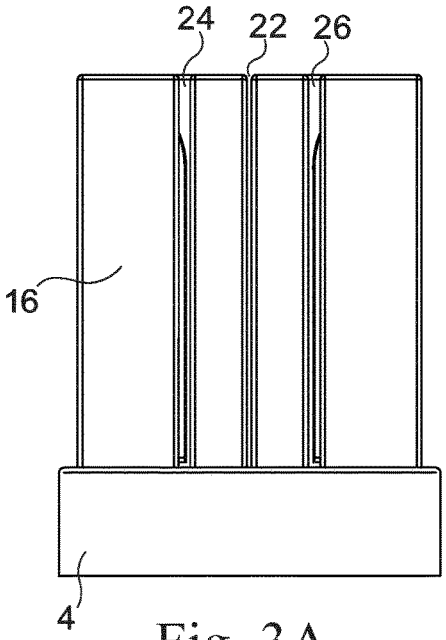
FIGS. 3A and 3B are front and rear views of the miter box of FIG. 1.
Figure 3B:
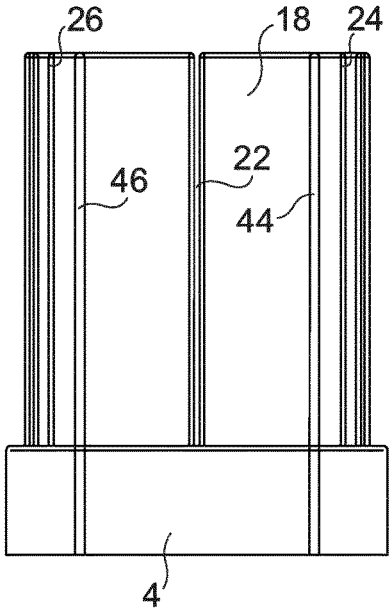
Figure 4:
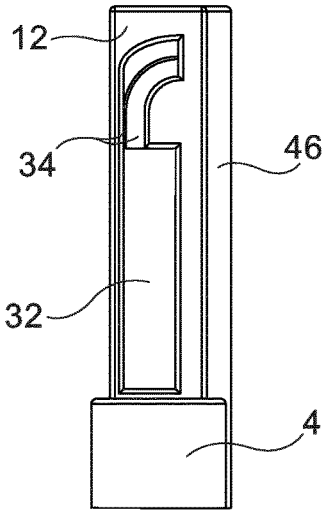
FIG. 4 is a lateral view of the miter box of FIG. 1.

Referring now to the drawings, FIG. 1 is a perspective view of an embodiment of a miter box 1, FIG. 2 is a perspective view of the miter box of FIG. 1 with a shaped element 9 to be cut, FIGS. 3A and 3B are front and rear views of the miter box of FIG. 1, and FIG. 4 is a lateral view of the miter box of FIG. 1.

Box 1 has, in a useful portion, a cross-section having, except for slots 22, 24, and 26 defining cut lines, a closed external shape. In other words, miter box 1 has a closed aspect, that is, unlike usual miter boxes, the miter box 1 comprises no U-shaped section having its open surface used to install the element to be cut. Box 1 has a general shape which depends on the cross-section of the element to be cut. In the illustrated example, box 1 preferably has a generally rectangular parallelepiped shape.

As illustrated in the drawings, box 1 comprises, along its length, a through recess 3 or opening emerging onto two lateral or end surfaces 12 of the box. The shape of opening 3 depends on the cross-section of the element 9 to be cut. In other words, the element 9 to be cut is intended to be inserted into the box 1 from one of its lateral surfaces 12 and, according to the length to be cut, to reemerge from the other lateral surface 12 of box 1.

The number of cutting slots will depend on the desired cutting options, but the box comprises at least one slot. In the illustrated embodiment, three slots are provided to respectively perform a straight cut (slot 22) and two cuts at +/−45 degrees (slots 24 and 26). In this case, slot 22 is preferably in the middle of slots 24 and 26, which preferably emerge close to the rear corners of the box, to ease use, as will be seen hereafter in relation with FIGS. 5A to 5E.

Slots 22, 24, and 26 are intended for the passing of a cutting tool, such as a saw blade or a cutter blade, and extend from upper surface 14 of box 1 all the way to a base 4. It is preferable that the slots follow vertical planes, respectively perpendicular to and at plus or minus 45 degrees with respect to the direction of through opening 3. They emerge onto at least three surfaces of the box (upper surface 14 and front and back surfaces 16 and 18). In the illustrated embodiment where the box is extended by a base, the slots stop at the level of this base 4.

On its rear surface 18, box 1 has two vertical ribs 44 and 46 (parallel to the planes of slots 22, 24, and 26) protruding from rear surface 18. The distance between the rib 44 or 46 and the closest surface 12 corresponds approximately to the distance between the opening 32 and the rear side 18. The position of rib 44 is approximately in the middle of the projection of slot 24 onto rear surface 18. The position of rib 46 is approximately in the middle of the projection of slot 26 onto rear surface 18. Ribs 44 and 46 are used to place the miter box in position to obtain, for angle cuts, a cut at the desired distance as will be seen hereafter in relation with FIGS. 5A to 5E. Thus, ideally, the position of ribs 44 and 46 is selected so that the cut is perfectly positioned.

In the illustrated embodiment, base 4 has horizontal dimensions greater than those of the rest of the box 1. This gives the box 1 stability, making its use easier. Alternatively, the base 4 may have the same horizontal cross-section as the rest of the box. Indeed, a function of the base is that the slots stop there. Preferably, in the presence of ribs 44 and 46, the depth of the base at the back of the box remains lower than the depth of ribs 44 and 46 so that these ribs remain protruding even at the level of base 4.

Opening 3 has a closed contour. Its shape is selected to correspond to the cross-section of the shaped element to be cut. In the illustrated example (FIG. 2), the shaped element is a baseboard 9 of the type described in document FR-A-2975418 of the applicant, formed of a body 92, made for example of foam covered with a finish coating 94, which is for example thermoformed, and which, in cross-section, protrudes from body 92 in its upper portion. In this example, the upper portion of coating 94 is curved and has a radius of curvature directed towards the foam body. Thus, recess 3 comprises a lower portion 32 (FIG. 4) having a rectangular cross-section corresponding to the cross-section of the lower portion of the baseboard, and, in its upper portion, a rounded shape 34 corresponding to the cross-section of the higher portion of coating 94 of the baseboard.

Adapting the shape of the recess to the cross-section of the shaped element to be cut has several advantages. On the one hand, this eases the holding of the element to be cut in the box, since it is maintained on all its surfaces. Thus, the cut is more accurate. On the other hand, it becomes possible to cut shaped elements having a cross-section with a non-convex shape without the risk of breaking or deforming the shaped element. Further, shaped elements having areas of different stiffnesses can be cut without the risk of deteriorating the shaped element.

Figure 5A:
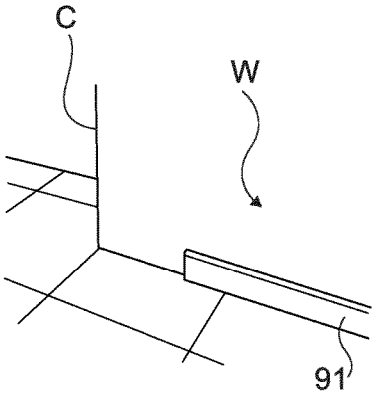
FIGS. 5A, 5B, 5C, 5D and 5E illustrate an example of use of a miter box.
Figure 5B:
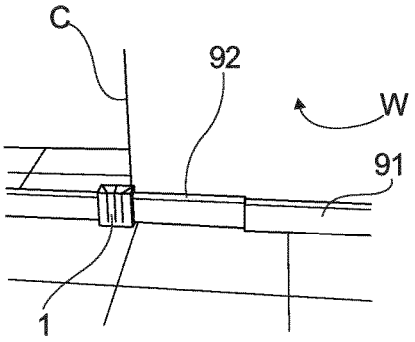
Figure 5C:
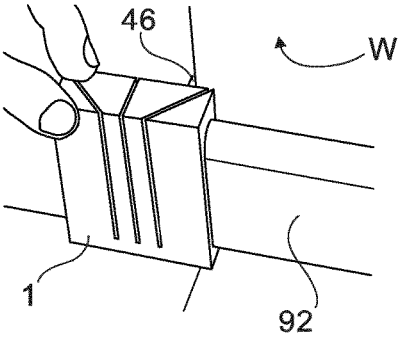
Figure 5D:
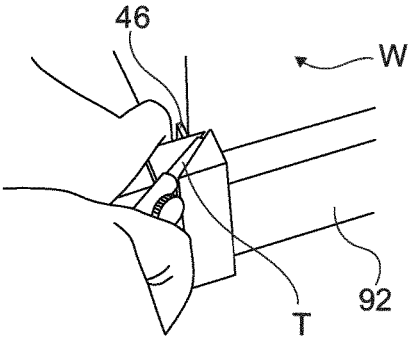
Figure 5E:
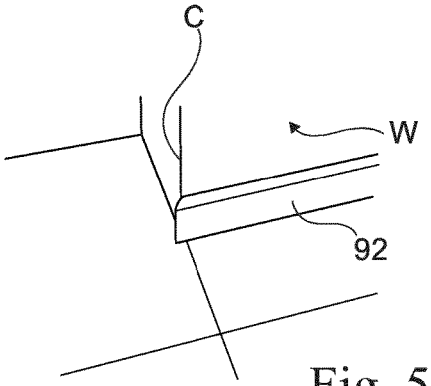

FIGS. 5A, 5B, 5C, 5D and 5E illustrate an example of use of a miter box. A baseboard 9 is assumed to be installed against a wall W comprising an angle, which is for example external. A first baseboard section 91 is assumed to be placed against the wall (FIG. 5A) but not to go all the way to corner C. A second section 92 of baseboard 9 is engaged into a box of the type illustrated in the previous drawings, and then positioned (FIG. 5B) so that the free (straight) end of section 92 bears against the free end of section 91. Due to the height of base 4, the two sections are not perfectly aligned here but this is not disruptive for cutting. As illustrated in FIG. 5C, the box is slid until rib 46 (in this example) is stopped against the corner of the wall. This rib enables the location of the cut line to be accurately positioned with respect to the angle. The illustrated example assumes a baseboard cuttable with a cutter T used as the cutting tool (FIG. 5D). Section 92 is then cut at the right length in position by using slot 26. Once the section has been cut, the box is removed and a section 92 ready to be fixed (for example, glued) to wall W is obtained.

The mode of use illustrated in FIGS. 5A to 5E benefits from a maximum number of advantages and options of the miter box. However, the box may also be used by measuring the lengths desired for the sections and by cutting the element without it being in place.

The miter box is preferably obtained by plastic molding. However, any other adapted material (wood, metal, etc.) may be suitable.

The dimensions of through opening 3 are preferably selected so that the shaped element can be freely inserted therein with a slight clearance. The larger the clearance, the more easy it is for the shaped element to pass, but the less accurate the cut, in particular for foam-type compressible materials. The smaller the clearance, the more accurate the cut, but the less easy the introduction of the shaped element to be cut. A compromise will depend on the shaped element and in particular on the material or materials in which it is formed.

Various embodiments have been described. Various alterations and modifications will occur to those skilled in the art. In particular, although the embodiments have been described in relation with an example intended for the cutting of a baseboard of the type described in above-mentioned document FR-A-2975418, the through opening may have any other shape adapted to the cross-section of a shaped element to be cut. Further, the size (width, height, depth) of the box is adapted to the cross-section of the element to be cut and to the number of desired slots.

The invention claimed is:

1. A miter box comprising front and rear opposing surfaces, two opposing lateral surfaces, and an upper surface, wherein one lateral surface includes in a first direction, a through opening having a closed contour and a shape adapted to the cross-section of an element to be cut, the miter box further comprising a slot defining a cut line entirely crossing the opening, characterized in that a rear surface of the miter box comprises a first slot opening and a protruding rib, approximately vertical, for aiding positioning of the box for angle cuts, wherein the slot follows a plane forming a non-perpendicular angle with the first direction, and wherein the protruding rib is arranged offset from the first slot opening and in a middle of a projection of the slot on the rear surface.

2. The miter box of claim 1, wherein the miter box has a generally rectangular parallelepiped shape.

3. The miter box of claim 1 wherein the opening emerges onto both lateral surfaces.

4. The miter box of claim 1, comprising a second slot following a plane perpendicular to the first direction, and a third slot following a plane forming a non-perpendicular angle with the first direction, wherein the first and third slots follow planes forming respective angles of plus 45 degrees and minus 45 degrees with the first direction.

5. The miter box of claim 4, wherein the planes do not intersect each other within a volume of the miter box.

6. The box of claim 1, wherein the slot emerges onto at least the upper, front and rear surfaces.

7. The box of claim 1, further comprising a base in which the slot or slots stops.

8. The miter box of claim 1, wherein the opening has a non-convex shape.

9. The miter box of claim 1, wherein the opening has a lower, rectangular portion and an upper portion having a rounded shape, the upper portion adjacent the upper surface of box.

10. The miter box of claim 1, comprising a second slot following a plane perpendicular to the first direction and having a second slot opening on the rear surface wherein the rib is positioned on the rear surface between the second slot opening and first slot opening.

11. A miter box comprising front and rear opposing surfaces, two opposing lateral surfaces, and an upper surface, wherein one lateral surface includes, in a first direction, a through opening having a shape adapted to the cross-section of an element to be cut, the miter box further comprising a first slot following a plane perpendicular to the first direction, and a second, angled slot following a plane forming a respective angle of either plus 45 degrees or minus 45 degrees with the first direction, wherein rear surface of the miter box comprises a first slot opening, an angled slot opening, and a protruding rib, approximately vertical, for aiding positioning of the box for angle cuts, and wherein the protruding rib is arranged offset from the first slot opening and in a middle of a projection of the angled slot on the surface between the first slot opening and the angled slot opening.

12. The miter box of claim 11, and further comprising a third, angled slot following a plane forming a respective angle of plus 45 degrees with the first direction, wherein the second slots follows a plane forming a respective angle of minus 45 degrees with the first direction.

13. The miter box of claim 12, wherein the planes do not intersect each other within a volume of the miter box.

14. The miter box of claim 11, wherein the through opening has a closed contour.

15. The miter box of claim 14, wherein the through opening has a lower, rectangular portion and an upper portion having a rounded shape.

16. The miter box of claim 11, wherein the slots emerge onto at least the upper, front and rear surfaces.

17. A miter box comprising: front and rear opposing surfaces, two opposing lateral surfaces, and an upper surface;

a through opening having a closed contour and a shape adapted to the cross-section of an element to be cut, the through opening accessible on the lateral surfaces and having a lower, rectangular portion and an upper portion adjacent the upper surface having a rounded shape; and three cut slots each defining a cut line entirely crossing the through opening, the three slots including a first slot following a plane perpendicular to the first direction, second slot following a plane forming a respective angle of plus 45 degrees with the first direction, and a third slot following a plane forming a respective angle of minus 45 degrees with the first direction, wherein the slots emerge onto at least the upper, front and rear surfaces.

* * * * *